United States Patent [19]

Kigyos

[11] 4,387,479

[45] Jun. 14, 1983

[54] INTERPROXIMAL TOOTHBRUSH

[75] Inventor: Frank Kigyos, Aurora, Ill.

[73] Assignee: Block Drug Company, Inc., Jersey City, N.J.

[21] Appl. No.: 263,781

[22] Filed: May 14, 1981

[51] Int. Cl.[3] ..... A46B 9/04

[52] U.S. Cl. ..... 15/167 R; 15/206; 300/21

[58] Field of Search ..... 15/105, 110, 111, 172, 15/176, 206, 167 R; 433/141, 142, 147; 300/21

[56] References Cited

U.S. PATENT DOCUMENTS

| | | | |
|---|---|---|---|
| D. 54,815 | 4/1920 | Campbell | D4/25 |
| D. 110,936 | 8/1938 | Wiseman . | |
| D. 120,382 | 5/1940 | Kerr | D4/25 |
| D. 157,669 | 3/1950 | Graves, Jr. | D4/25 |
| D. 240,981 | 8/1876 | Hill et al. | D4/25 |
| D. 247,461 | 3/1978 | Perfect | D4/20 |
| D. 250,148 | 11/1978 | Hill et al. | D4/25 |
| D. 251,038 | 2/1879 | Hill et al. | D4/25 |
| D. 255,511 | 6/1880 | Hill et al. | D4/25 |
| D. 262,236 | 12/1981 | Tarrson et al. | D24/11 |
| 430,909 | 6/1890 | Wonderly | 15/172 |
| 592,838 | 11/1897 | Solem | 15/154 |
| 1,173,721 | 2/1916 | Huwitz . | |
| 1,296,067 | 3/1919 | Fuller . | |
| 1,296,719 | 3/1919 | Veeck . | |
| 1,470,710 | 10/1923 | Davis | 15/167 |
| 1,996,205 | 4/1935 | Jackson | 132/89 |
| 2,017,881 | 10/1935 | Wiseman | 32/59 |
| 2,319,841 | 5/1943 | Bate | 15/206 |
| 2,573,201 | 10/1951 | Kelley et al. | 401/283 |
| 2,624,062 | 1/1953 | Knoderer | 15/167 R |
| 2,677,842 | 5/1954 | Sherwin | 15/210 |
| 2,867,831 | 1/1959 | Francis | 15/210 |
| 3,101,727 | 8/1963 | Wiseman | 132/93 |
| 3,204,275 | 9/1965 | Baker | 15/172 |
| 3,559,226 | 2/1971 | Burns | 15/167 |
| 3,720,975 | 3/1973 | Nelson | 15/206 X |
| 4,053,959 | 10/1977 | Wiley | 15/110 X |
| 4,109,339 | 8/1978 | Dietrich | 15/167 R |
| 4,222,143 | 9/1980 | Tarrson et al. | 15/105 |

FOREIGN PATENT DOCUMENTS

| | | | |
|---|---|---|---|
| 1044 | 3/1979 | European Pat. Off. | 433/147 |
| 16815 | 4/1898 | Switzerland | 15/167 R |
| 544870 | 4/1942 | United Kingdom . | |

OTHER PUBLICATIONS

Hager & Werken "Spiraclean" Instrument.
Denticator Sheet, 1976.
Perio Pak Advertisement.
E-Z Handle Sheet.
Mini-Brush Company, Sales Material.
Dental Instrument.

*Primary Examiner*—Peter Feldman
*Attorney, Agent, or Firm*—Ostrolenk, Faber, Gerb & Soffen

[57] ABSTRACT

An interproximal toothbrush has an elongated handle having one end bent at an obtuse angle relative to the remainder of the handle, a bore along the central axis of the one end extending from the terminal portion thereof into the one end, an elongated bristle support carrying a plurality of bristles radially extending therefrom at a first portion and the second portion of the bristle support extends through the surface of the one end of the elongated handle to the bore and is then carried within the bore by that portion which extends toward the remainder of the handle.

7 Claims, 4 Drawing Figures

INTERPROXIMAL TOOTHBRUSH

BACKGROUND OF THE INVENTION

It is well known that the removal of dental plaque daily is necessary to prevent and arrest periodontal disease and that the first areas to show signs of such diseases is the interproximal area. Many dental stimulating and cleansing aids have been proposed in the past such as dental floss, toothpicks of all shapes and sizes, tufted interproximal brushes, and the like. However, such devices have been generally unsatisfactory because the cleaning elements or bristles extend parallel to the surface of the teeth rather than extending substantially perpendicular to the teeth surface.

Burns, in U.S. Pat. No. 3,599,226, provides an interproximal toothbrush having elongated wire members twisted on each other with radially extended bristles fixedly secured in place therebetween. A laterally opening passageway is provided in an elongated handle for receiving ends of the twisted wire members which are secured in place by an adjustable retaining member and the handle is bent to position the wire members at an obtuse angle relative to the remainder of the handle. The lateral passageway extends all the way through the handle so that the wire not carrying the bristle extends behind the handle. Burns provides a slot on the handle surface and bends the wire to be captured in the slot so as to retain the wire, the end portion of the handle being threaded for receiving a nut which is rotated into firm and locking engagement with the wire members to secure the bristle supporting wire members in place. There is also an interproximal toothbrush being sold in the United States under the trademark Proxibrush which employs the same arrangement described in the Burns patent except that the screw fitting nut is replaced by a pressure fitting sleeve.

The Burns and Proxibrush configurations include a nut or sleeve unit which must be positioned adjacent the bristles of the brush. This additional structure interferes with the proper use of the brush since the user must take care that the sharp edges of the nut or screw do not cut his gums. Additionally, in assembling the brush and at those times when the nut or sleeve slips during use, the sharp end of the wire is exposed giving rise to the likelihood of cuts and abrasions.

Accordingly, it is the object of this invention to provide a new interproximal toothbrush which has a continuously smooth surface extending downwardly from the brush area without any projections which can cut the gum of the user in use or the fingers of the user when the toothbrush is assembled.

This and other objects of the invention will become apparent to those skilled in the art from the following detailed description in which FIG. 1 is a plan view of the toothbrush of the present invention;

SUMMARY OF THE INVENTION

This invention relates to a toothbrush for cleaning interproximal areas and more particularly to a toothbrush which has an elongated handle having one end bent at an obtuse angle relative to the remainder of the handle, a bore along the central axis of that end extending from the terminal end thereof to the handle, an elongated bristle support carrying a plurality of bristles extending radially from one portion thereof and the remainder of the bristle support extending into the end of the handle to the bore and then extending into the bore toward the remainder of the handle.

DESCRIPTION OF THE INVENTION

Figure 1:
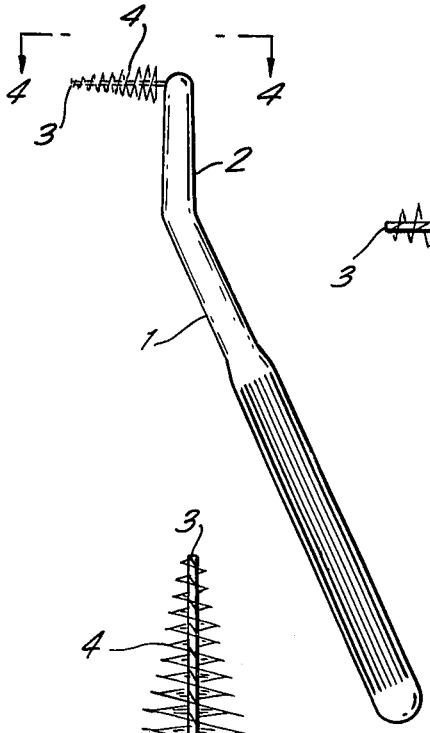

FIG. 1 shows the interproximal toothbrush of the present invention which has an elongated handle 1, preferably cylindrical in shape, which has one end 2 bent at an obtuse angle from the balance of the brush. End 2 is adapted to carry the brush element. The terminal end of end 2 is rounded having a radius R which is approximately the same as the axial radius R′ of end 2.

The brush element is, as shown in the Figures, an elongated wire 3 which carries bristles 4 extending radially from a common axis and fixedly secured in place on wire support 3. Wire 3 is preferably a single length of wire which is bent back on itself and twisted. By placing the bristles 4 between the two lengths of wire before twisting, the bristles are fixedly held on the wire support and will extend axially thereof. Bristles 4 can be made of any suitable flexible material and are preferably nylon. As apparent from the figures, the combination of wire 3 and bristles 4 has a conical cross-section.

Figure 4:
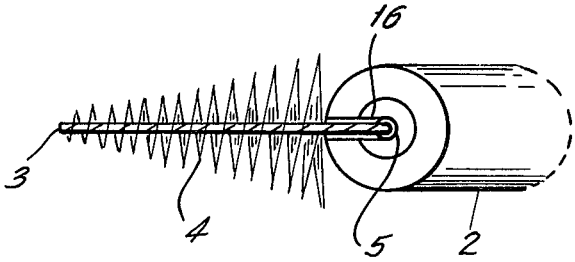
FIG. 4 is an end view of the brush end of FIG. 1.
Figure 2:
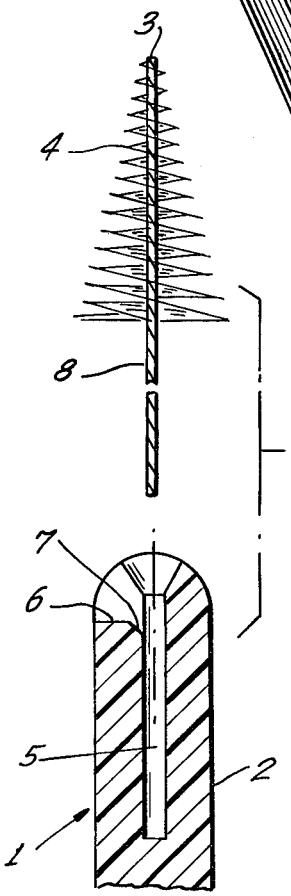
FIG. 2 is a cross-section through the axis of the brush carrying end before insertion of the brush.
Figure 3:
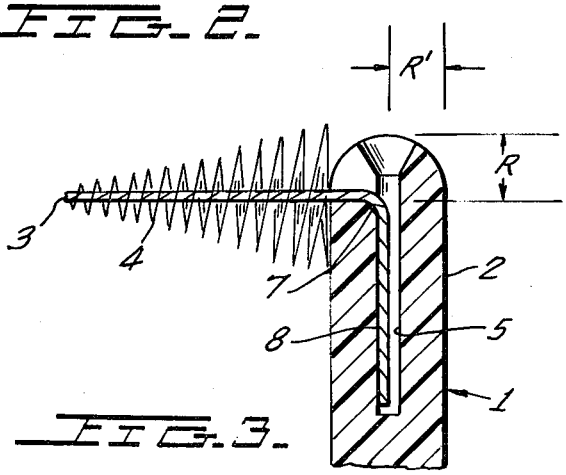
FIG. 3 is a cross-section of the brush carrying end after insertion and capturing of the brush.

FIGS. 2 and 4 show end 2 before and as, respectively, the brush element composed of wire 3 and bristles 4 is inserted. A bore 5 extends from the terminal end of end 2 with an inward taper for a short distance thereof along the central longitudinal axis of handle 1. Slot 6 extends from one end of bore 5 to the axial surface of end 2. The wall defining one end of slot 6 is substantially perpendicular to the central longitudinal axis of bore 5 and meets the axis of end 2 at a tapered shoulder 7 which joins slot wall 6 and the bore 5 at about 45° angles.

To assemble the brush, the portion 8 of wire 3 which does not carry bristles 4 is inserted into bore 5 which, due to its configuration, serves as a self-taping guide. The brush element is then bent upwardly around the shoulder 7. As a result, wire 3 assumes a general "L" shaped configuration with the base of the "L" carried in bore 5 and the upward portion of the "L" extending generally parallel to the wall of slot 6 and axially out of end 2. The portion of end 2 behind the brush element, i.e., between the brush element and the terminal end of end 2 is then sealed by any method such as, for example, sonic welding which causes the pastic body material of end 2 to flow smoothly over and enclosing the slot 6. This securely captures wire 3 in bore 5 but presents a smooth continuous surface over the region of slot 6. As a result, a continuous, smooth surface extending downwardly from the bristles 4 is achieved which contributes to the safety of the brush. There are no wire projections which can cut the gum or the fingers of the user. Further, the self-taping configuration of bore 5 permits the toothbrush to be assembled by mechanical apparatus without fear that the bendable wire will not be properly positioned. The union between the brush and the handle is also very secure.

Various changes and modifications can be made in the present invention without departing from the spirit and scope thereof. Various embodiments which were disclosed herein were for the purpose of further illustrating the invention but were not intended to limit it.

What is claimed is:

1. An interproximal toothbrush consisting essentially of an elongated handle having one end bent at an obtuse angle relative to the remainder of the handle, a bore along the central longitudinal axis of said one end extending from the terminal end thereof, an elongated bristle support having first and second portions, said first portion of said bristle support extending through the axial surface of said one end at a point displaced from the terminal end to and substantially perpendicular to said bore and then carried in that portion of said bore extending toward said remainder of said handle, said second portion of said bristle support carrying a plurality of bristles extending radially therefrom so as to extend toward opposed tooth surfaces when said support is between adjacent teeth, said second portion of said bristle support and bristles, in combination, having a conical cross-section, the exterior surfaces of said elongated handle in the vicinity of said first portion bristles being smooth, continuous and rounded whereby, in use, the user's gums will not confront a discontinuous surface.

2. The interproximal toothbrush of claim 1 wherein said elongated handle and said bore are generally cylindrical.

3. The interproximal toothbrush of claim 2 wherein a first segment of said first portion of said bristle support extends through the axial surface of said one end, a second segment of said first portion of said bristle support is carried in said bore, and wherein said first and second segments are at approximately right angles to one another.

4. The interproximal toothbrush of claim 3 wherein said terminal end of said one end is rounded at a radius which is approximately the radius of said one end.

5. A method of assembling the interproximal toothbrush of claim 1 comprising providing an elongated handle having one end bent at an obtuse angle relative to the remainder of the handle and a bore extending along the central longitudinal axis of said one end extending from the terminal end thereof and a slot extending from one end of said bore to the axial surface of said one end, the wall defining one end of said slot being substantially perpendicular to said bore and meeting said bore to form a shoulder; providing an elongated bristle support having first and second portions; said second portion carrying a plurality of bristles extending radially therefrom; inserting said first portion into said bore to a point beyond said shoulder; bending said first portion around said shoulder to a generally L-shaped configuration of which the base is carried in said bore and the upward portion is generally parallel to said wall extending axially out of said one end; and sealing a part of said slot between said first portion and the terminal end of said one end such that said one end is smooth, continuous and rounded in the vicinity of said bristles.

6. The method of claim 5 wherein said sealing is effected by sonic welding.

7. The method of claim 6 wherein said shoulder is tapered and said second portion and bristles, in combination, have a conical cross-section.

* * * * *